US005192141A

United States Patent [19]

Chung et al.

[11] Patent Number: 5,192,141

[45] Date of Patent: Mar. 9, 1993

[54] MULTI-DIMENSIONAL MEDIA PRINTER WITH MEDIA BASED REGISTRATION AND FREE EDGE PRINTING

[75] Inventors: T. Mark Chung, Carrollton; Anthony G. Orchard, Dallas; William H. Baker, Arlington; Charles L. Bradford, Garland, all of Tex.

[73] Assignee: Tidemark Corporation, Newark, Calif.

[21] Appl. No.: 694,930

[22] Filed: May 2, 1991

[51] Int. Cl.[5] ..... B41J 11/20

[52] U.S. Cl. ..... 400/56; 400/73; 400/642; 400/625; 271/119; 271/122; 271/242; 271/259; 271/111

[58] Field of Search ..... 400/56, 58, 73, 279, 400/320, 642, 62-64, 579, 624, 625, 629; 271/119, 122, 242, 111, 259

[56] References Cited

U.S. PATENT DOCUMENTS

| | | | |
|---|---|---|---|
| Re. 31,200 | 4/1983 | Sukonick et al. . | |
| 3,940,746 | 2/1976 | Vittorelli . | |
| 4,197,590 | 4/1980 | Sukonick et al. . | |
| 4,232,860 | 11/1980 | Brown | 271/119 |
| 4,248,415 | 2/1981 | Steinhilber . | |
| 4,262,591 | 4/1981 | Cook . | |
| 4,264,396 | 4/1981 | Stewart . | |
| 4,269,403 | 5/1981 | Stephens et al. | 271/121 |
| 4,272,204 | 6/1981 | Quinn, Jr. et al. | 400/320 |
| 4,422,376 | 12/1983 | Teraoka . | |
| 4,432,830 | 2/1984 | Jue . | |
| 4,516,208 | 5/1985 | Sakura et al. . | |
| 4,519,048 | 5/1985 | Albellana et al. . | |
| 4,591,998 | 5/1986 | Kuperman et al. . | |
| 4,623,418 | 11/1986 | Gombrich et al. . | |
| 4,635,212 | 1/1987 | Hatazawa . | |
| 4,644,339 | 2/1987 | Ruder . | |
| 4,710,886 | 12/1987 | Health . | |
| 4,712,928 | 12/1987 | Brandenstein . | |
| 4,718,784 | 1/1988 | Drisko . | |
| 4,755,955 | 7/1988 | Kimura et al. . | |
| 4,769,648 | 9/1988 | Kishino et al. . | |
| 4,778,288 | 10/1988 | Nakamura . | |
| 4,779,083 | 10/1988 | Ishii et al. . | |
| 4,779,105 | 10/1988 | Thomson . | |
| 4,802,778 | 2/1989 | Tanahashi | 400/642 |
| 4,875,174 | 11/1989 | Olodort et al. . | |

FOREIGN PATENT DOCUMENTS

| | | | |
|---|---|---|---|
| 3215225 | 11/1983 | Fed. Rep. of Germany | 400/73 |
| 3230190 | 2/1984 | Fed. Rep. of Germany | 400/642 |
| 57-6974(A) | 1/1982 | Japan . | |
| 0183539 | 10/1983 | Japan | 271/122 |
| 0153732 | 9/1984 | Japan | 271/122 |
| 0179278 | 9/1985 | Japan | 400/73 |
| 0244569 | 12/1985 | Japan | 400/73 |
| 0043580 | 3/1986 | Japan | 400/642 |
| 0146579 | 7/1986 | Japan | 400/73 |
| 0152478 | 7/1986 | Japan | 400/320 |
| 0203039 | 9/1986 | Japan | 271/119 |
| 0243746 | 10/1986 | Japan | 271/242 |
| 0036246 | 2/1987 | Japan | 271/122 |
| 0227778 | 10/1987 | Japan | 400/279 |
| 0233255 | 10/1987 | Japan | 400/73 |
| 0235145 | 10/1987 | Japan | 271/122 |
| 0087437 | 4/1988 | Japan | 271/122 |
| 0308330 | 12/1989 | Japan | 271/242 |
| 326581 | 2/1958 | Switzerland | 271/122 |
| 1564155 | 4/1980 | United Kingdom | 271/122 |
| 2041335 | 9/1980 | United Kingdom | 271/122 |

OTHER PUBLICATIONS

"Document Autofeed Mechanism and Multifeed Detection", IBM Tech. Discl. Bulletin, vol. 22, No. 11, Apr. 1980, p. 4953.

"Record Sheet Deflector", IBM Tech. Disclosure Bulletin, vol. 19, No. 6, Nov. 1976, p. 2040.

*Primary Examiner*—Eugene H. Eickholt

*Attorney, Agent, or Firm*—Fliesler, Dubb, Meyer & Lovejoy

[57] ABSTRACT

A printer 20 for imprinting data on a variety of multi-dimensional media 62 has media based registration and can accomplish free edge printing for printing data adjacent edges. The printer 20 includes a transport mechanism 52 for accurately transporting and positioning the media 62 before a print head 102. Further, the printer 20 includes a carriage mounted sensor 144 for media edge detection, registration and media size determination. A media presentation mechanism 96 ensures that the media 62 is appropriately presented and maintained at the optimal distance from and orientation with respect to the print head 102.

45 Claims, 8 Drawing Sheets

MULTI-DIMENSIONAL MEDIA PRINTER WITH MEDIA BASED REGISTRATION AND FREE EDGE PRINTING

FIELD OF THE INVENTION

The present invention is directed to a printed for imprinting data on media.

BACKGROUND OF THE INVENTION

Even with the current and sustained boom in office automation, with powerful desktop computer work stations, with sophisticated wordprocessing, data base and graphic software packages, and with a proliferation of multi-bin laser printers, there is an evident dearth of compatible equipment which can print media of varied dimensional measurements such as, for example, the wide variety of envelopes, postcards, labels and other stock. Certainly multi-bin laser printers can print on a variety of media sizes and qualities. However, such laser printers generally have media paths which operate quite similarly to photocopiers and thus require that the media be substantially flexible in order to conform to the radii of the various wheels and rollers which define the media feed path. Some systems, notably the MacIntosh® computer systems offered by Apple® Computer provide for the feeding of envelopes as well as sheet material for imprinting thereon. However, such systems are not adept at rapidly handling a substantial volume of multi-dimensional media such as envelopes which might be prepared in a moderately sized business office. Certainly services which are in the business of mailing hundreds of thousands of envelopes a day for purposes of surveys and promotion have large, high-throughput label or envelope printers for handling the volume. The cost and physical size of such printers is generally prohibited for purposes of use in the average business office.

Alternatively, such services and business offices use envelopes with windows which match the location of the address on the letter to be positioned inside the envelope.

The prior art does demonstrate devices for printing labels and the like. One of these devices is disclosed in U.S. Pat. No. 4,875,174 entitled "Instant Label Printer for Host Computer". This patent teaches a stand-alone, peripheral device which connects to a desktop computer and is capable of printing labels, such as labels for envelopes. Based on the mechanical structure of this system, there is no teaching of printing other than labels provided on a continuous roll. Envelopes of various sizes along with media stock of various thicknesses and sizes could not be effectively stored or fed through this system. As the labels to be printed are provided on a continuous roll, problems associated with feeding individual media, which may have different dimensional quantities has not been addressed. Further, the need to provide appropriate registration for purposes of positioning data in desired locations on multi-dimensional media, as well as printing on the leading and trailing edges, is not contemplated. Printing adjacent to edges of media is becoming increasing important for purposes of conforming to U.S. Post Office standards for FIM and Post Net Code numbers in order to speed the mail through the U.S. Postal system.

Another patent, U.S. Pat. No. 4,248,415 entitled "Apparatus for Feeding Sheets of Paper from a Magazine to a Printing Office Machine", discloses a media handling mechanism which can be retrofitted to an office printer and provides for feeding single sheets of media from one or more trays to the printer. The media is held in place in the tray with separating tab mechanisms. These separating tab mechanisms serve to snap the topmost sheet of media from the stack of media when a separating roller drives the topmost sheet from the stack into the printer platen. Additionally, the printer platen is caused to rotate backwardly against the direction of media feed from the separating roller in order to provide registration of the media.

Again, such a device is not set up for handling multi-dimensional media, for registering such multi-dimensional media with respect to the data to be printed, or for that matter, for providing printing adjacent the edge of such multi-dimensional media as is advantageous according to U.S. Post Office guidelines.

SUMMARY OF THE INVENTION

Thus, there is a need to provide a low cost reliable multi-dimensional media printer with media based registration and free edge printing for the office automation boom. Such a printer would need to be compatible with a variety of computer systems and be sufficiently small so that the printer would effectively fit into the space requirements of a business office and handle the media throughput required.

Accordingly, it is an object of the present invention to provide a low cost, compact printer.

It is further an object of the present invention to provide a printer which can handle a great variety of media having varying thicknesses, widths and lengths such as, for example, the great variety of envelopes which are available.

It is a further object of the present invention to be able to handle such media of various dimensions without deforming the media. It is thus an object to provide a printer that can accommodate such media and not requiring the media to conform to the radii of rollers. It is an object to accomplish this task and, as indicated above, while maintaining the printer in a compact configuration.

It is a further object of the present invention to provide a printer which can sense the presence of media properly positioned in the printer, which can sense the dimensions of the media in order to appropriately position the data to be imprinted on the media, and which can prevent the printer from printing off the edge of the media.

It is another object of the present invention to provide a printer which can print immediately adjacent the edge of the media in order to satisfy U.S. Post Office guidelines for such markings. It is an object to accomplish this printing at a free edge of the media so that the markings can be placed immediately adjacent such edge.

It is a further object of the present invention to provide a printer which does not require a bale or other holddown device for holding a stack of envelopes in place and which can effectively feed only one envelope or card not held in position by the weight of a stack of such envelopes or cards, or a holddown device.

It is another object of the present invention to be able to appropriately deskew the media being fed, should the media be inadvertently provided at an angle with respect to the proper orientation of the leading edge of the media.

It is a further object of the invention to provide a media transport mechanism which uses only a single transport motor for transporting the media from the input bin to an output bin. Thus with a single motor, the media is picked up from the input bin by a pick roller, separated by the feed roller, deskewed, transported and presented to a print head, before finally being provided to the output bin.

It is a further object of the present invention to provide a media presentation mechanism for presenting the media to a print head so that the free leading edge of the media as well as the trailing edge of the media can be printed adjacent thereto. It is also an object to provide for the proper orientation and spacing of the media with respect to the print head to maximize the efficiency of the print head and the quality of the letters and symbols printed.

It is a further object of the present invention to provide for a printer which can handle multi-dimensional media, but does not smear the data printed thereon in taking the media from adjacent a print head to an output bin.

Accordingly, there is provided a printer for imprinting data on a variety of multi-dimensional media including a means for transporting the media, which media transporting means includes a pick roller adapted for contacting the bottommost media from a stack of media and for urging the bottommost media out of the bottom of the stack of media. The printer further includes a feed roller adapted for engaging the bottommost media urged out from the stack of media by the pick roller and for initiating the feeding of the bottommost media through the printer in a media feeding direction. The feed roller has a plurality of media engaging notches provided about the periphery thereof which can engage the leading edge of the media in order to feed the media.

The printer further includes a pick roller which is substantially rectangular in cross-section, with the corners of the rectangle removed in order to provide additional surface to assist in urging the bottommost media out of the bottom of the stack of media.

The printer further includes a deskewing roller for receiving and deskewing the media from the feed roller. The deskewing roller deskews by rotating in a direction reverse to the direction of media feed. Once deskewing has been accomplished, the deskewinq roller reverses and rotates in the direction of the media feed in order to move the media to be printed through the printer.

The printer further includes a media presentation mechanism for presenting the media to the print head in a manner so that the print head can print data adjacent a free leading edge of the media and adjacent the trailing edge of the media and so that the media is appropriately spaced from the print head.

The printer of the invention further includes the positioning of the various rollers which can support the media through the printer in such a manner so that the media does not have to conform to the radii of the rollers while still maintaining the proper presentation of the media before the print head.

Another aspect of the present invention includes the mounting of a sensor means on a carriage which transports the print head relative to the media. Such mounting allows the printer, through the sensing means to determine the location of all edges of the media, to determine whether the print head is properly functioning and imprinting data on the media, to determine whether the media is present or not or whether a jam has occurred, and to ensure proper registration of the printed data relative to the actual edges of the media as opposed to a datum established on the printer itself.

Further objects, aspects and advantages of the invention are presented herein throughout the description of this invention.

DETAILED DESCRIPTION OF THE PREFERRED EMBODIMENT

Figure 1:
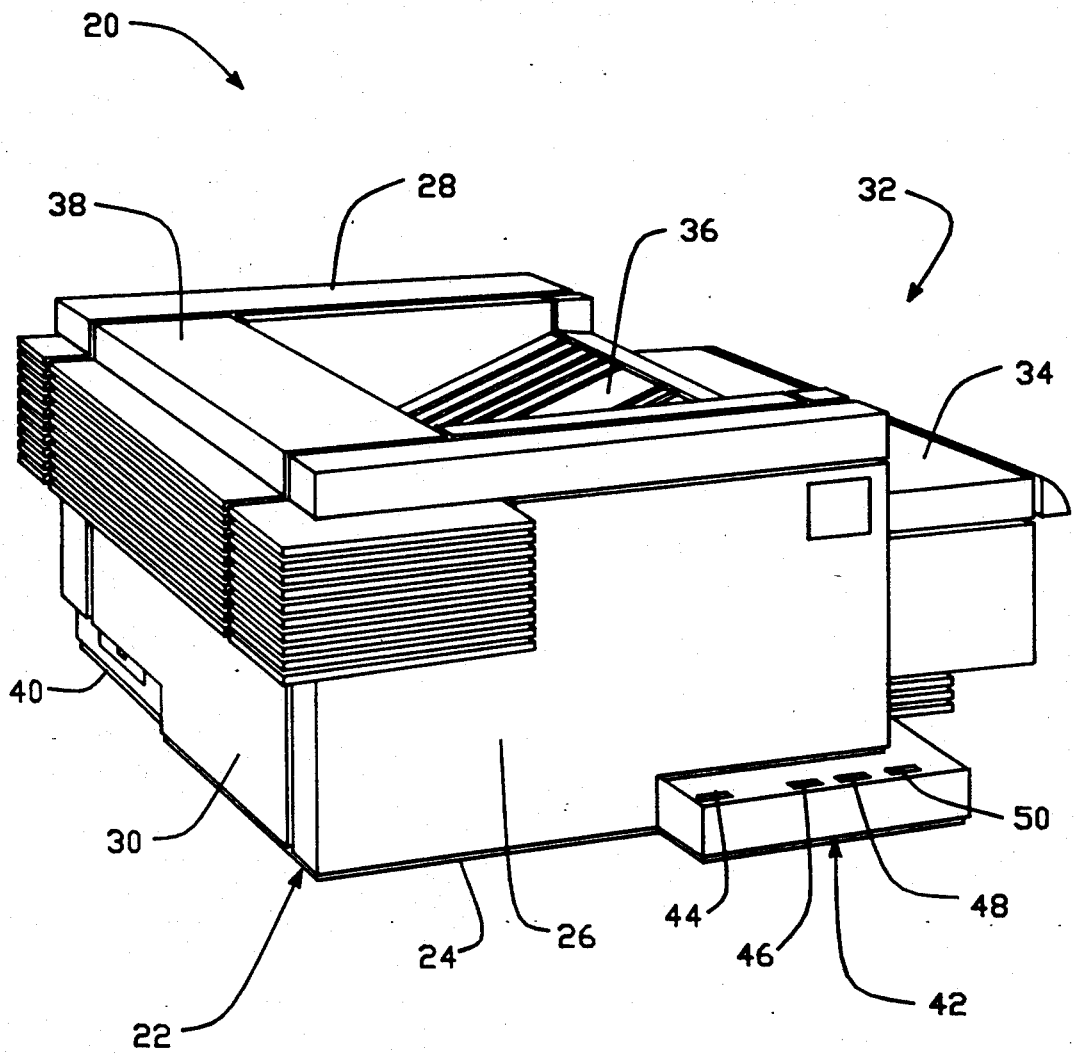
FIG. 1 depicts a first perspective view of an embodiment of the invention.

With reference to the figures and in particular FIG. 1, the printer 20 of the invention is depicted.

The printer 20 is optimally and primarily designed to feed a stack of seventy-five number 10 envelopes. However, it is to be understood that numbers 6 through number 11 envelopes, of varying densities including international stock, can be feed as well. In addition, the printer can feed a wide range of label and card stock.

Figure 2:
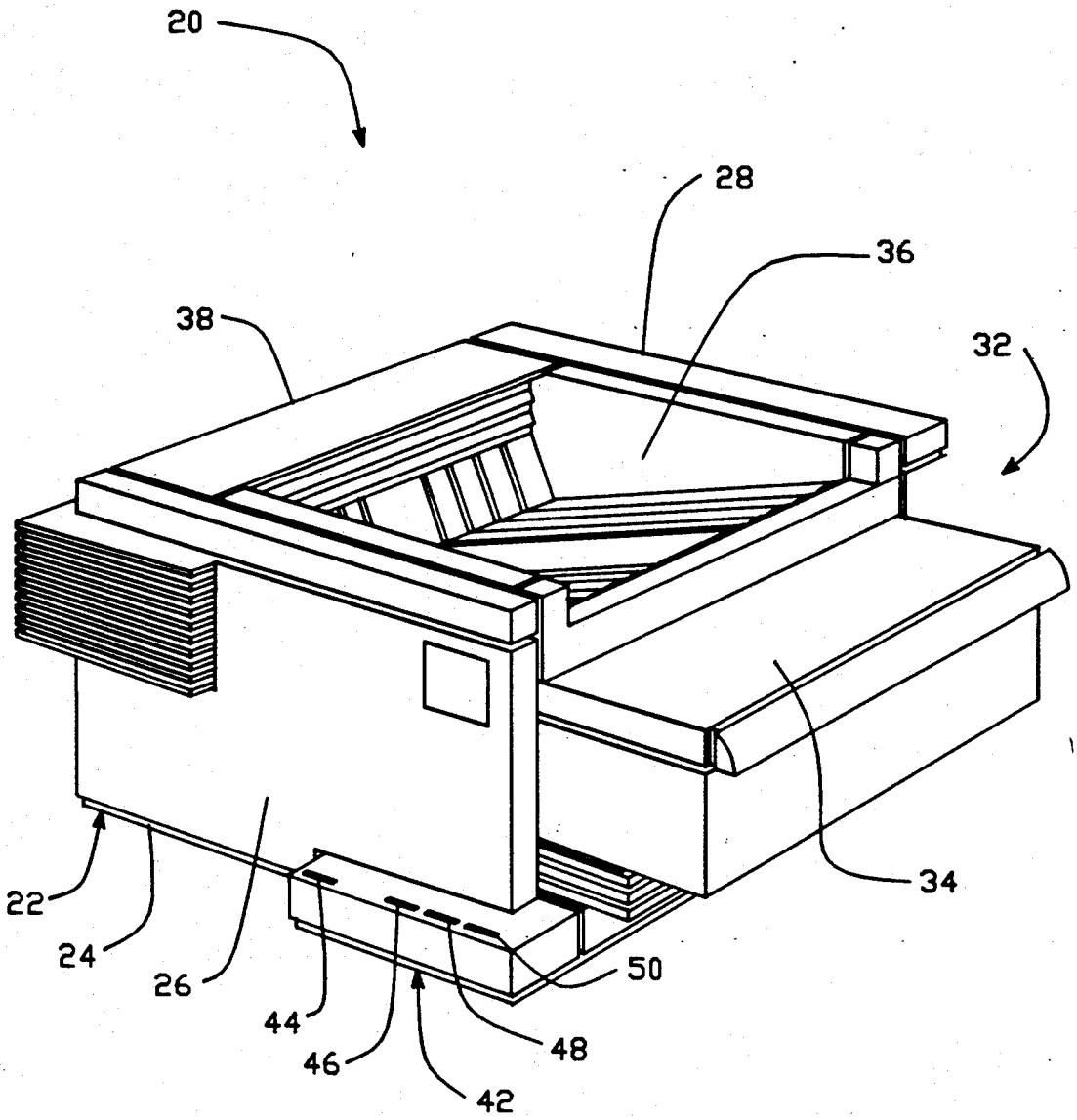
FIG. 2 depicts a second perspective view of an embodiment of the invention of FIG. 1.

As can be seen in FIGS. 1 and 2, printer 20 includes a housing 22 with a base 24. The housing 22 includes a front cover 26, a rear cover 28, and a switch panel 30. Also provided is an input bin 32 which has an input bin lid or cover 34. Adjacent and above the input bin 32 is an output bin 36. A carriage cover 38 is located immediately adjacent to the output bin 36. The carriage cover 38 encloses the print head and carriage mechanism which will be described below. The printer 20 additionally includes a power panel 40, which can receive a cord for receiving power from a wall receptacle, and which has an on/off switch. The power panel, located behind the power panel wall 40 received power from a DC power source which is connected through the power panel wall 40 to a wall receptacle. A LED cover 42 is provided which mounts LED's 44, 46, 48 and 50, which are designated Power, Path, Feed and Paper respectively. The Power LED 44 indicates that power is provided to the printer 20. The Path LED 46 indicates that the media is appropriately positioned with respect to the print head. The Feed LED 48 indicates that the media is appropriately positioned with respect to the transport mechanism inside the printer. The Media LED 50 indicates that there is media to be imprinted in the input bin 32.

Printer Transport Mechanism

Figure 3:
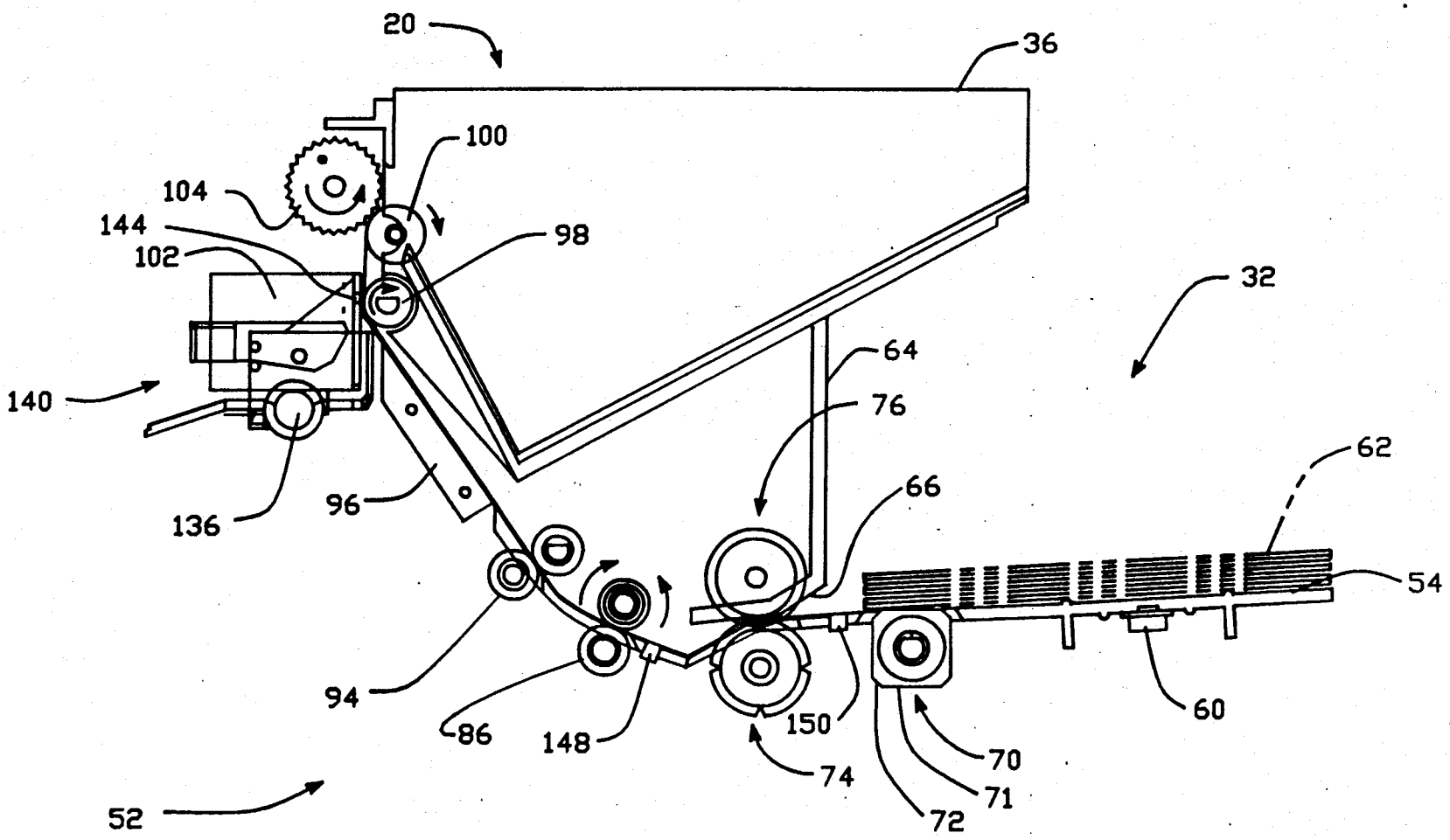
FIG. 3 depicts a schematical representation of the media feed path of the embodiment of the invention of FIG. 1.
Figure 4:
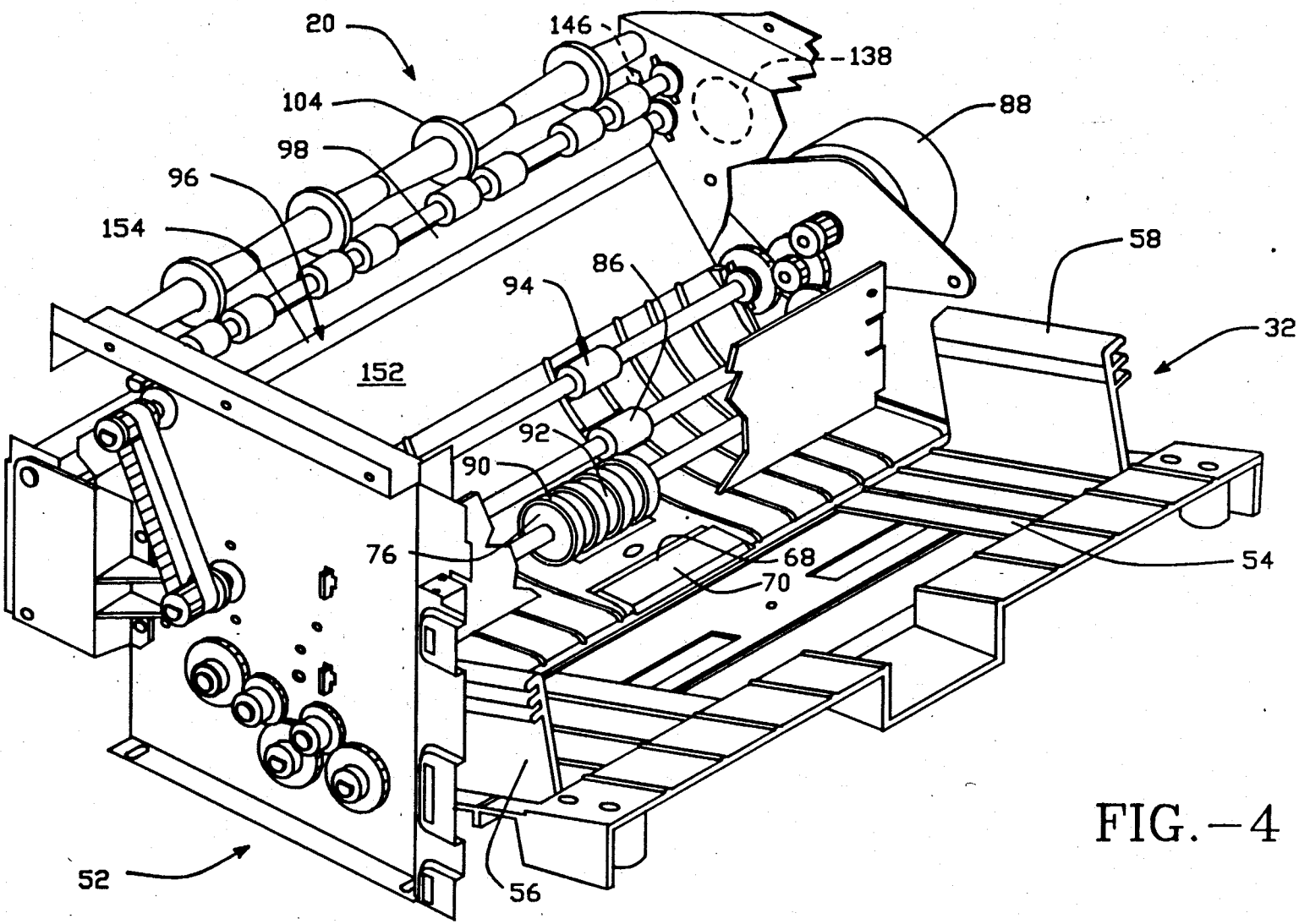
FIG. 4 depicts a perspective view of the media feed path of an embodiment of the invention with certain portions removed or broken away in order to reveal several aspects of the invention.
Figure 5:
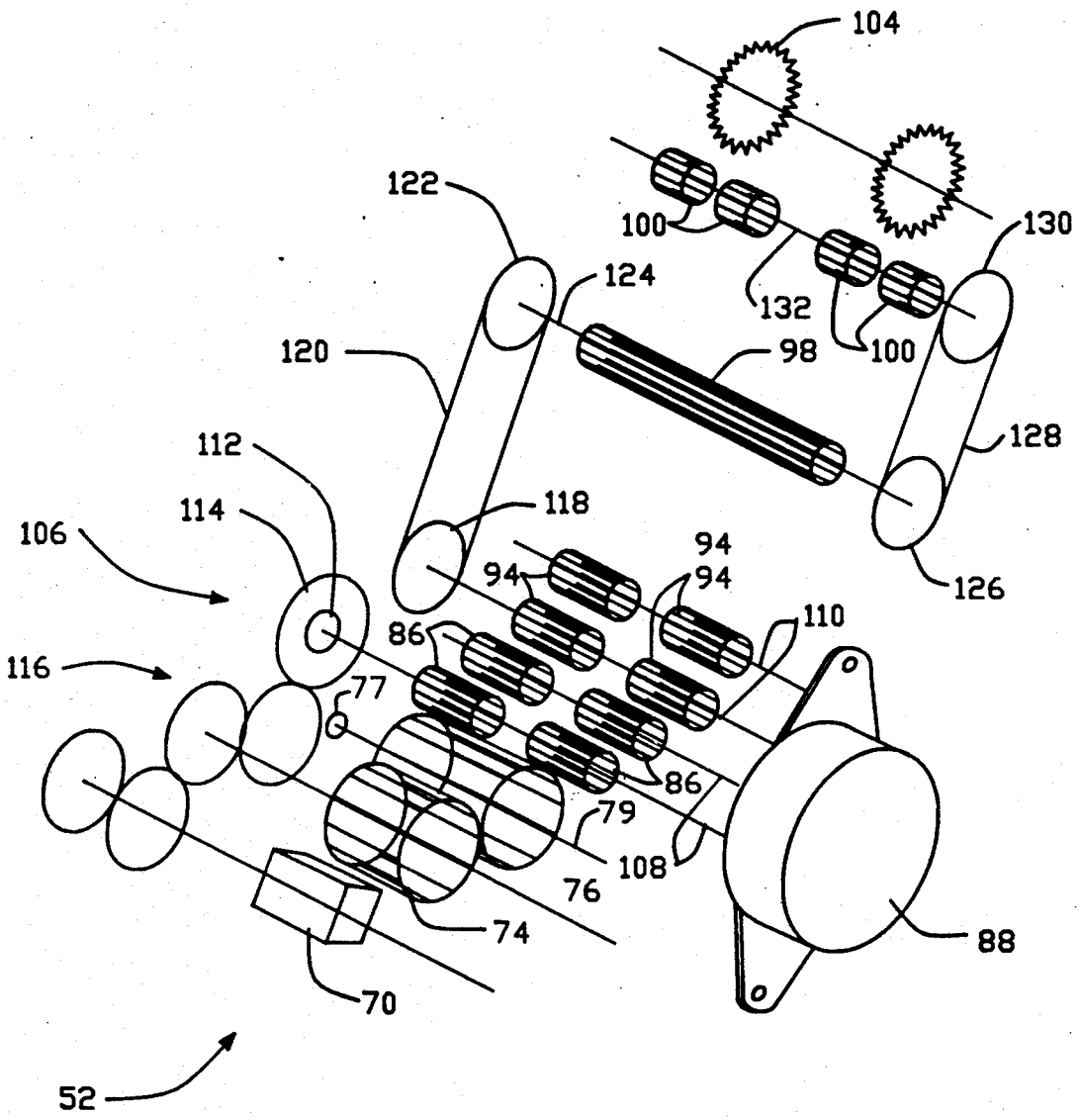
FIG. 5 depicts the drive train which drives the media through the media feed path of the embodiment of the invention of FIG. 3.
Figure 7:
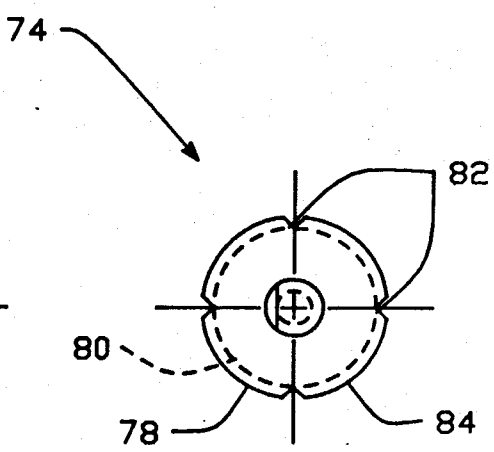
FIG. 7 depicts a side view of the feed roller of the invention of FIG. 6.
Figure 6:
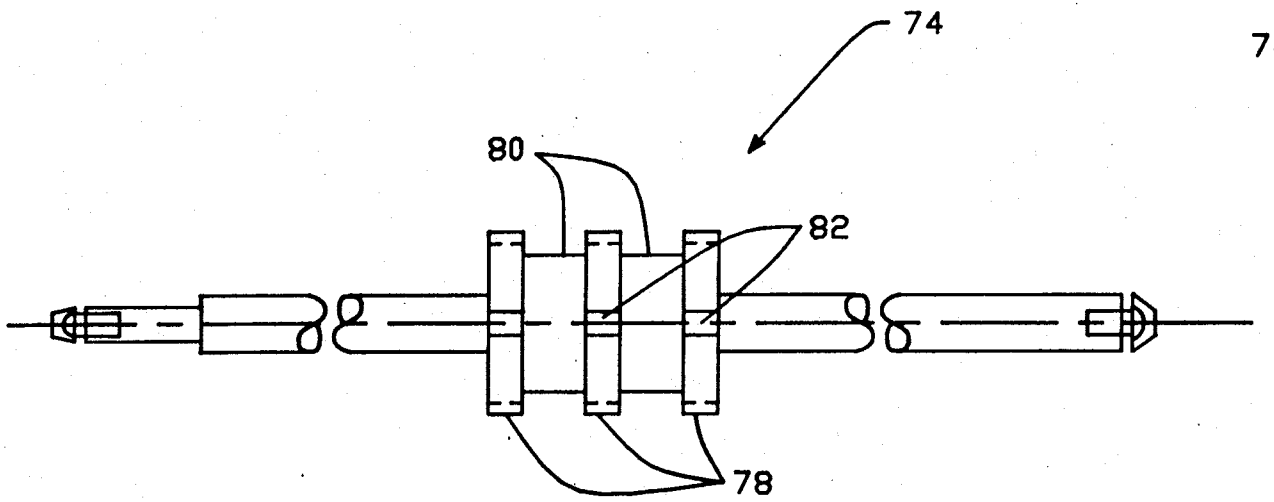
FIG. 6 depicts a front view of an embodiment of the feed roller of the invention.
Figure 8:
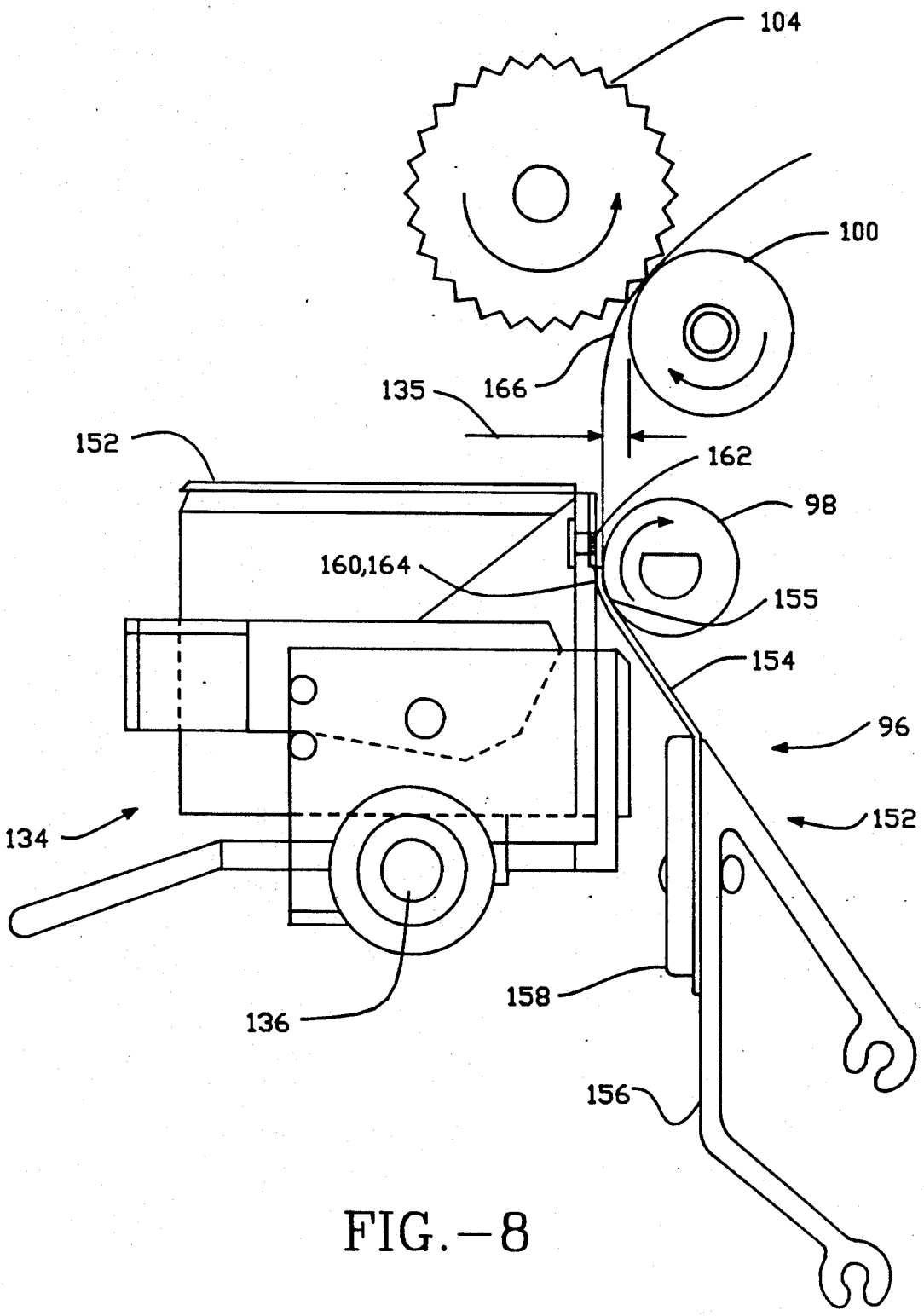
FIG. 8 depicts a side view of the print head, print head carriage and transport mechanism as well as the media presentation mechanism of the embodiment of the invention of FIG. 3.

The transport mechanism 52 for transporting the media through the printer 20 is generally depicted in FIGS. 3, 4, and 5 with various aspects also depicted in FIGS. 6, 7, and 8. In FIGS. 3 and 4, the housing 22 of the printer 20 has been removed in order to faoilitate a depiction and understanding of the transport mechanism 52. In these figures, it can be seen that the input bin 32 is comprised of a sloping media guide 54 which has stack centering guides 56, 58 which can move simultaneously together and apart based on a rack and pinion arrangement 60. A stack of media 62, shown in phantom, can be positioned on top of the media guide 54. The input bin 32 further includes a media retard fence 64 which has a sloping guide 66. The media retard fence 64 provides a stop for the stack of media 62 while the guide 66 allows the bottommost media to be fed past the media retard fence 64.

Located in the bottom of the input bin 32 in the media guide 54 and through a slot 68 is a pick roller 70. As can be seen in FIGS. 3 and 4, pick roller 70 is generally rectangular in cross-section and in fact, in the preferred embodiment is square in cross-section with flats 71, and has cut-off or truncated corners 72. The pick roller 70 is positioned against and engages the bottommost media of the stack of media. As the pick roller 70 rotates in a media feeding direction, it lifts and transports the bottommost media to and through the sloping guide 66 of the media retard fence 64. The design of the pick roller 70 with the flats 71 is so that the roller oscillates the stack of media up and down until the leading edge of the bottommost media is feed through the sloping guide 66 and engaged by the nip or intersection of the feed roller 74 and the retard roller 76. The truncated corners 72 are provided in order to give more surface area between the flats 71. These truncated corners 72 provide substantial area to contact with and continue the movement of the bottommost media in the media feeding direction. The rectangular nature of the pick roller 70 with the flats 71 has a distinct advantage over a circular roller in this position in that a circular roller could not guarantee the reliability of the pick roller 70 in causing the media to repeatedly pass by the sloping guide 66 and enter the intersection of the feed roller 74 and the retard roller 76.

In a preferred embodiment, the pick roller 70 has the characteristics of high coefficient of friction with media, high stability and high durability (low wear). It is contemplated that ideally the pick roller 70 will have a coefficient of friction of between 1.6 and 2.0. In one embodiment of the invention. The roller is comprised of a polyisoprene elastomer (rubber).

The feed roller 74, as depicted in greater detail in FIGS. 6 and 7, is substantially circular in cross-section. Feed roller 74, in a preferred embodiment, includes three sections 78 of a large diameter spaced apart by two sections 80 of a small diameter. The larger diameter section 78 includes, in a preferred embodiment, notches 82 provided through the peripheral edge 84. These notches are in a preferred embodiment substantially "V" shaped, with one located in each quadrant. The notches enable the last envelope to be fed by the feed roller 74 without the need of a bale or other external load plate being placed on the stack of media 62. As the stack of media is depleted, this feed roller 74 becomes the main feeding mechanism into the deskew rollers 86.

Intermeshing with the feed roller 74 is the above retard roller 76. The retard roller 76 is not driven by a transport motor 88 as are the other rollers as will be described hereinbelow with respect to FIG. 5. The retard roller 76 is operatively coupled with a one-way clutch mechanism which allows the roller to rotate in FIG. 3 in a counter-clockwise direction (opposite media feed direction) but prevents the retard roller 76 from rotating in a clockwise direction. This mechanism is a slip clutch 77 which is connected to the end of shaft 79 upon which the retard roller 76 is mounted. This facilitates the feeding of the bottommost media from right to left in FIG. 3 in a media feeding direction, but prevents the feeding of the higher media in the input state. The retard roller 76, as can be seen in FIG. 4, includes four sections 90 with larger diameters which are spaced apart by sections 92 with smaller diameters. The larger diameter sections 90 are positioned about and intermesh with the larger diameter section 78 of feed roller 74 with the two innermost positioned sections 90 positioned immediately adjacent the smaller diameter sections 80 of feed roller 74. This intermeshing provides for engagement of the media being fed through the intersection of the feed roller 74 and the retard roller 76. The permitted counter-clockwise rotation is caused by the spring-back of the retard roller 76 after the trailing edge of each piece of media passes by this roller. Counter-clockwise rotation of this roller is also caused by the removal of input media 62 from the input bin 32 by an operator. Any counter-clockwise rotation of this roller 76 thus caused results in a new surface of the largest diameter sections 90 to be presented. This allows uniform wear on the friction surfaces 90 which extends the service life thereof.

In a preferred embodiment, the desired characteristics of the feed roller 74 are a super high coefficient of friction with paper of at least 1.5 times the coefficient of friction of the retard roller, a superior wear resistance and a high stability (low age hardening and plasticizer migration). Such a roller can be comprised of a polyisoprene rubber or a silicone coated rubber.

The retard roller 76, whose primary function is to prevent multiple media feed has, in a preferred embodiment, desirable characteristics such as a coefficient of friction with media in the range of 1.0, high wear resistance and good stability. Currently a microcellular urethane is being used.

From the nip or intersection of the feed roller 74 and retard roller 76, the media is fed to a bi-directional set of deskew rollers 86. The deskew rollers 86 accept the media, deskew the media, and transport it to a set of bi-directional transport rollers 94.

The deskew rollers 86 are initially operated in a manner so as to urge the media in a direction opposite the media feeding direction in order to provide a deskew function. Deskew is appropriate when the leading edge of the media for any reason is not perpendicular to the media feed direction at this point. This angular off-set is corrected by driving the leading edge of the media into contact with both pairs of the deskew rollers 86. It is to be understood that in other embodiments of the invention, that the feed roller 74 can drive the media alternatively into a set of non-rotating deskew rollers 86 and thus provide the appropriate deskew of the media.

Once the media has been deskewed, the rotation of the deskew rollers 86 is reversed in order to feed the media in the media feeding direction from right to left in FIG. 3.

In a preferred embodiment, the characteristics of the deskew rollers 86 include high wear resistance, high durometer, low compression set and good stability. In addition, strict control of the outer diameter is required so that the rollers do not themselves introduce a skew during transport of the media. Currently the deskew rollers are comprised of a millable gum urethane rubber.

The bi-directional transport rollers 94 are provided in order to transport the media the distance from the deskew rollers 86 to the media presentation mechanism 96 and the preprint roller 98. The media presentation mechanism 96 and the preprint roller 98 as well as the output rollers 100 ensure the proper presentation of the media to the print head 102 so that the data gets properly printed onto the media.

The transport rollers 94 must also have diameters which are closely matched so that these rollers will not add skew to the media. In a preferred embodiment, the characteristics of this roller include high durometer (60–70 Shore A), low compression set and high stability. Presently, this transport rollers 94 are comprised of a millable gum urethane rubber.

The preprint roller 98 advances the media to the print zone and assists in the proper presentation of the media before the print head 102. This preprint roller 98 is a metering roller and therefore is of significant importance in the printer 20. The diameter of the preprint roller must be very precise and accurate. Deviations in the diameter may adversely affect the print quality and resolution. The hardness of the roller must thus be as hard as possible without sacrificing a high coefficient of friction. Experience has shown that substantial compression of this roller will alter how far the media will be advanced per revolution. High friction is needed in the roller to ensure that the roller is the predominant media roller in the printer 20. Currently, in a preferred embodiment, a millable gum rubber is being used for this preprint roller 98. Preferably, the roller is a hard roller (durometer ranging from 80–90 Shore A) with a coefficient of friction near 2.0. High stability and toughness are also important characteristics of the preprint roller 98.

The output rollers 100 which are the final roller driven by the transport motor 88 are used to give the final kick to the media in order to eject it into the output bin 36. Output rollers 100 are the only fully exposed roller in the printer 20 and has a very high stability against age-hardening or plasticizer migration. Friction of the output rollers must be as high as possible so that these rollers can properly eject the trailing edge of the media into the output bin 36.

Positioned adjacent to the output rollers 100 is a plurality of star wheels 104. Star wheels are positioned between adjacent output rollers 100 (FIG. 4). The star wheels 104 are essentially rollers which have an outer periphery which is continually notched thereabove in order to provide a plurality of projections, much as a gear. The purpose of the star wheels is to assist in guiding the media, as driven by the output rollers 100, so that the media can be directed into the output bin 36. As the star wheels 104 contact the printed surface of the media, immediately after the surface has been printed, it is important that the star wheels 104 have the least contact as possible with the surface in order to prevent smearing. Thus, the projections allow for the appropriate contact and direction of the media into the output bin 36 without smearing any data printed on the media.

The star wheels 104 supply net force to the output rollers 100 without smearing or retransferring ink back onto the media. Desirable features of the star wheel are low ink wetability and point or line contact with the media.

Turning to FIG. 5, the drive train 106 of the transport mechanism 52 is shown in greater detail. This drive train 106 includes the transport motor 88. It is to be understood that other drive trains are possible, but that the drive train as shown in FIG. 5 is the preferred drive train.

As can be seen in FIG. 5, the drive train 106 operably connects the transport motor 88 to the pick roller 70, the feed roller 74, the deskew rollers 86, the transport rollers 94, the preprint roller 98, and output rollers 100. The star wheel 104 are not driven by the transport motor 88 but are shown for completeness. Further, the retard roller 76 is not driven by the transport motor 88, but again is shown for completeness. It is to be understood that in other embodiments of the invention, the retard roller 76 can be coupled to transport motor 88 in order to drive the retard roller 76 in a direction opposite to the media feed direction in order to enhance the media separation function of the feed and retard rollers. This can also be accomplished by incorporating a motor with clutch 77 (FIG. 5).

It is to be understood that the transport motor 88 includes the appropriate gears and directly drives the shafts 108, 110 upon which the deskew rollers 86 and the transport rollers 90 are mounted. It is to be understood that also mounted on one of the shafts 108, is a clutch 112 clustered with a drive gear 114. Drive gear 114 drives the plurality of other gears 116 which cause the feed roller 74 and the pick roller 70 to rotate as it is understood in the art.

One of the shafts 110 which mounts the transport rollers 94 has mounted thereon a pulley 118 with a belt 120 provided thereupon. Belt 120 engages a pulley 122 which is mounted on a shaft 124 which also mounts the preprint roller 98. Thus, rotation of pulley 118 rotates pulley 122 and preprint roller 98. Also mounted on shaft 124 is a second pulley 126 which has a belt 128 provided thereon. Belt 128 also engages another pulley 130 which is mounted on shaft 132 which in turns mounts the output rollers 100. Thus, rotation of the motor 88 rotates the transport rollers 94, the preprint roller 98 and the output rollers 100.

In operation, with the motor 88 turning in a direction in order to allow media to be fed from the right to left in FIG. 3 (the media feeding direction) both the pick roller 70 and the feed roller 74 are rotating in order to feed the media in the media feeding direction while the deskew rollers 76, the transport rollers 94, the preprint roller 98 and the output rollers 100 are rotating opposite to the media feeding direction. Once the media is deskewed, the direction of the rotation of the deskew rollers 86, the transport rollers 94, the preprint roller 98 and the output rollers 100 are reversed in order to move the media in the media feeding direction. Simultaneously, the rotation of the pick roller 70 and the feed roller 74 is declutched by clutch 112 and pick roller 20 and feed roller 74 do not rotate and thus do not feed new media or affect the feeding of media already being transported to the print head.

Thus, it is to be understood that the present invention provides for a media transport mechanism which uses only a single transport motor to pick, separate, deskew and transport the media.

Figure 9:
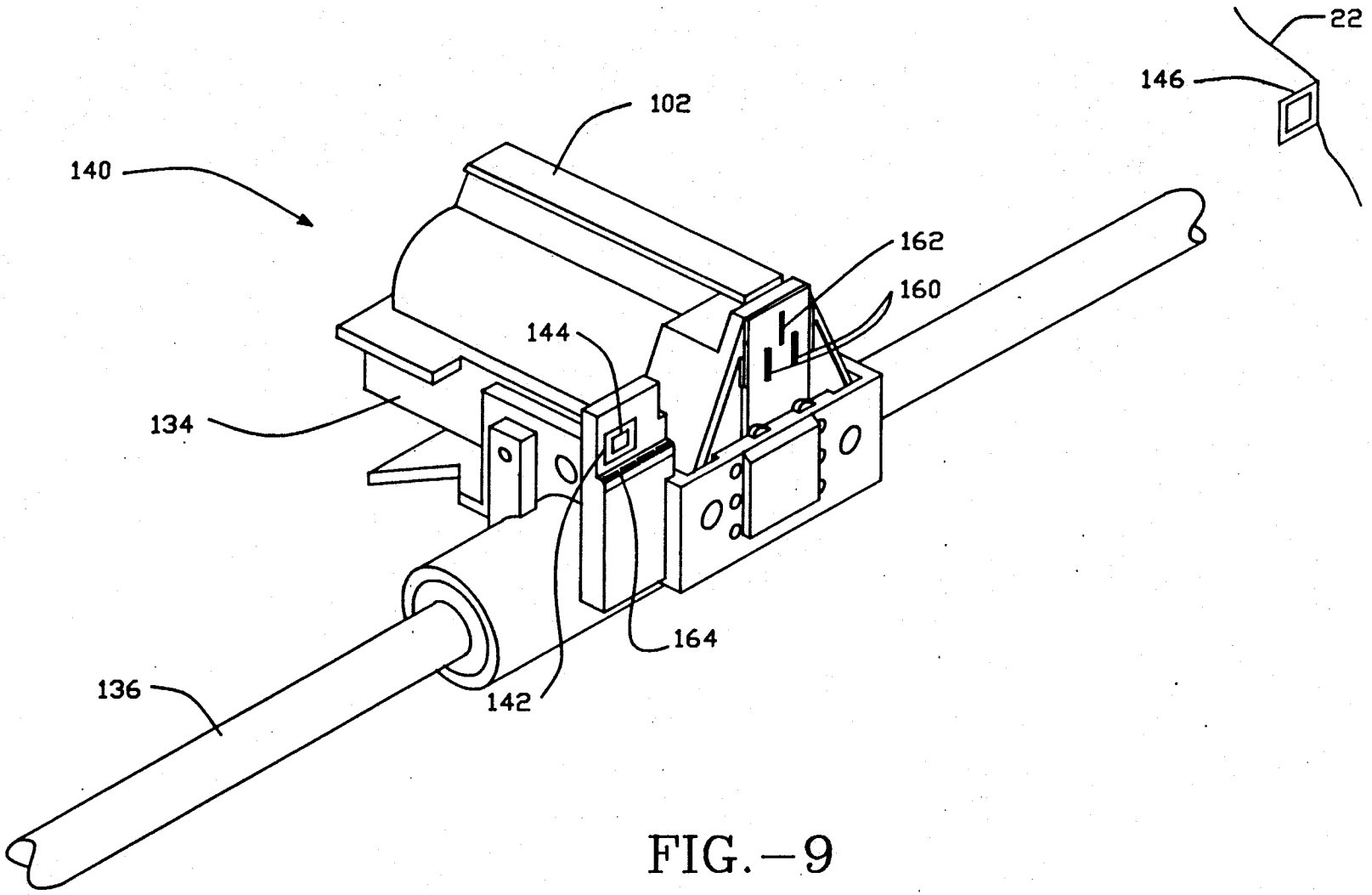
FIG. 9 depicts a perspective view of the print head and print head carriage of FIG. 8.

Print Head Carriage Assembly and Sensor:

As can be seen in FIG. 9, the print head 102, which is a commercially available ink jet print head (such as those available from Hewlett Packard), is mounted on a shuttle 134 which comprises part of carriage assembly 140. Shuttle 134 is slideably positionably on a shaft 136 in a direction which is substantially perpendicular to the direction of the media feed. Through gearing and/or pulley arrangements, as are known in the art, the shuttle 134 is moved along shaft 136 by a carriage motor 138 (FIG. 4).

The shuttle 134 includes a mount 142 for mounting a sensor for detection of the media. In a preferred embodiment, this sensor 144 as well as the other sensors referred to hereinbelow are comprised of infrared emitters and detectors. Other types of sensors known in the art can also be used.

The carriage motor 138, the shuttle 134, the shaft 136 and all the gearing and pulley arrangements are collectively referred to as the carriage assembly 140.

As the sensor is mounted on the carriage, the sensor 144 traverses the media with the print head perpendicular to the direction of the media being fed through the printer 20. This sensor 144 has a number of distinct advantages. First the sensor 144 can detect the leading edge of the media in order to allow for printing immediately adjacent the edge of the media. This is important in order to follow U.S. Post Office guidelines with respect to the FIM Code and Post Net Code.

As the sensor 144 transverses the media the sensor 144 can also detect the right and left edges of the media to determine that the media is properly positioned in the printer and that the data will be properly registered with respect to the media. Further, the sensor can detect if the size of the media (i.e. the length of the media from right to left), is the proper size to be printed up for the data to be printed. Next the sensor can detect if the ink jet head is functioning properly by reading the data imprinted on the media much as a bar code reader would detect a bar code. Additionally the sensor, sensing the edges of the media, can prevent the print head from spraying ink off the media. The sensor 144 can also detect a jam. Further the sensor can detect a home reference point 146 positioned in a stationary manner with respect to the housing 22 in order to provide a reference. The home reference point 146 is located adjacent one end of the shaft 136. Thus the carriage can re-home itself with respect to the housing 22 as required.

As can be seen in FIG. 3, other media sensors 148 and 150 are located through and secured to the media guide 54 immediately before the deskew rollers 86 and immediately after the pick roller 70, respectively. The media sensor 148 located immediately before the deskew roller 70 is used in the determination of the width of the media from the leading edge to the trailing edge of the media. Further, this sensor determines that media is being engaged by the deskew rollers. The sensor 150 immediately following the pick roller 70 is used to determine that there is media in the input bin 32.

Media Presentation Mechanism:

The media presentation mechanism 96 which presents the media in a desired manner to the print head 102 includes a deflector assembly 152. The presentation mechanism 96 operates in cooperation with the preprint roller 98 and the output rollers 100 as well as in cooperation with various wear surfaces on the print head and the shuttle 134 as described below in order to afford proper media presentation to the print head 102. In a preferred embodiment, it is desirable that the media 166 (FIG. 8) be presented in a vertical manner to the print head 102. This is accomplished by use of the deflector assembly 152 which includes a deflector 154 which in a preferred embodiment is comprised of stamped stainless steel and a stiffener 156 which in a preferred embodiment is comprised of extruded aluminum. The deflector 154 is secured to the stiffener 156 by a steel retainer 158. The stiffener 156 prevents excessive bowing of the deflector 154 as the media passes through the preprint roller 98. As can be seen in FIG. 8, the deflector 154 is appropriately shaped for multi-point contact in order to direct, in combination with the preprint roller 98, the media into a vertical position directly opposite the print head 102.

Further, it is to be understood that when different thicknesses of media are fed through the preprinted "nip", the deflector 154 bows a different amount. The print head 162 meanwhile is registered to the deflector 154. The shuttle 134 can pivot about its central shaft 136 when the deflector 154 bows different amounts and thus, the gap between the print head 162 and the media remain unchanged for widely different thickness media.

The deflector 154 provides nipping force to the preprint roller 98, and deflects the media so that the leading edge ejects vertically as it enters into the print zone adjacent the print head 102. There is an air gap between the deflector 154 and the preprint roller 98 in order to prevent the high friction preprint roller 98 from coming into contact with the deflector 154, and thus overloading of the transport motor 88. The desirable characteristics of the deflector 154 are high stiffness, flatness and good surface finish for camming to the print head wear surfaces. In a preferred embodiment, the air gap between the preprint roller 98 and the deflector 154 is approximately 0.005 inches with a range of 0.005 to 0.008 inches. And the ideal nozzle to media distance is approximately 0.039 inches.

The distance of the media from the print head is additionally maintained by wear surfaces 160 which are defined on the print head 102 itself and located on either side of and at the lower end of the print nozzle 162. The wear surfaces 160 engages the end 155 of the deflector 154 and ensures that the media is held at a proper distance from nozzle 162. The wear surfaces 160 are generally comprised of a plastic and are integral with the print head 102. In the particular Hewlett Packard print head, wear surfaces 160 comprise protective bumps which are disposed adjacent and below the print nozzle. This present design allows for 0.005 inches of wear to occur on these wear surfaces 160 at which time the secondary wear surface 164, as discussed below is contacted by the deflector 154. Thus, the wear surfaces in combination prevent the media gap from changing by more than 0.005 inches.

A secondary wear surface which is generally glass reinforced plastic in a preferred embodiment, is provided immediately below the sensor mount 142 at wear surface 164. Wear surface 164 ensures that the media does not come closer than a specified distance to the print nozzle 162 should the primary wear surfaces 160 wear before the print head 102 runs out of ink and is discarded.

As can be seen in FIG. 8, the output rollers 100 are located immediately above but offset from the preprint roller 98 by a distance identified by the reference number 135. In particular, the axis of rotation of the output rollers 100 are offset from a vertical plane which runs through the axis of rotation of the preprint roller 98. This offset, which in a preferred embodiment is approximately 0.35 inches from the surface of the preprint roller 98 to the surface of the output rollers 100, is used to accommodate the thickness of the media such as media 166 which is positioned in FIG. 8. Due to the thickness of the media 166, the media cannot conform exactly to the radii of the output rollers 100. Were the output rollers 100 not so offset, the media would bulge towards the printer between the preprint roller 98 and the output rollers 100, thus potentially varying the spacing between the media and thereby affecting the quality of the print formed by the print head.

It is further to be understood that the media presentation mechanism 96 and the sensor 144 allows for accurate free edge printing of the media (as discussed above with respect to sensor 144). The task of printing very close to the edge of the media, requires that the printing process occur while the media leading edge is still in a free state, that is before the media is captured by the output rollers 100 but after this media exits from the effective nip formed by the preprint roller 98 and the deflector 154.

It is to be understood that the print quality provided by print head and in this particular case, the Hewlett Packard ink jet print head is directly affected by the gap between the head and the media which is being printed. The Hewlett Packard print head provides the best quality print if the gap is maintained between the distances of 0.025 and 0.045 inches. By positioning the head at a nominal distance of 0.035 inches from the media, and allowing the head to bear against and end 155 of the deflector 154, this distance is maintained across the media. Consequently, according to the invention, the print quality across the media is maintained.

Industrial Applicability:

The operation of the printer 20 of the invention is as follows:

With power to the printer 20 turned on and with a stack of media in the input bin 32, an appropriate signal from a computer (not shown) causes media to be fed through the transport mechanism 52 and simultaneously sensed by the sensors and subsequently presented to the print head 162. The print head then prints the desired data onto the media which is then transported and deposited into the output bin 36.

The present invention has the distinct advantages of being able to feed a multiplicity of multi-dimensioned media while providing for media base registration so that the data is properly positioned with respect to the media and while providing for free edge printing so that appropriate data can be printed adjacent to the leading and the trailing edge of the media. The printer 20 further allows for and accommodates multi-thicknesses of media without unduly manipulating the media, while maintaining a compact base size and while maintaining a proper print head to media distance to ensure good print quality.

Other advantages and objects of the invention can be obtained from a review of the figures and the appended claims.

It is to be understood that other embodiments of the present invention can be fabricated and come within the spirit and scope of the claims and invention.

We claim:

1. A printer for imprinting data on a variety of multi-dimensional media including a means for transporting the media, which media transporting means includes:

a pick roller means adapted for contacting the bottommost media from a stack of media and for urging the bottommost media out from the bottom of the stack of media;

a feed roller means adapted for engaging the bottommost media urged out from the stack of media by the pick roller means and for initiating the feeding of the bottommost media through the printer in a media feeding direction;

wherein said feed roller means includes a feed roller with a plurality of media engaging notches provided about the periphery of the feed roller, which notches allow a leading edge of the media to be caught by the feed roller means.

2. The printer of claim 1 wherein said feed roller means includes:

a retard roller with means for intermeshing with the feed roller;

said feed roller including means for intermeshing with the retard roller;

said retard roller including means for allowing the retard roller to rotate in a direction reverse to the media feeding direction but not in the media feeding direction.

3. The printer of claim 1 wherein said pick roller means includes a pick roller which is substantially rectangular in cross-section, with the corner of the rectangle removed in order to provide additional surface to assist in urging the bottommost media cut from the bottom of the stack of media.

4. The printer of claim 1 further comprising deskew roller means for receiving and deskewing the media from the feed roller means.

5. The printer of claim 4 wherein said deskew roller means includes a deskew roller and means for bi-directionally driving the deskew roller selectively (1) in a direction reverse to the media feeding direction while the feed roller means is feeding the media in a media feeding direction in order to deskew the media when the media contacts the deskew roller and (2) in a media feeding direction.

6. The printer of claim 1 including:

media input bin which has a bottom which is slanted downwardly in the media feeding direction;

which media input bin includes a media retard fence for retarding movement of a stack of media in the media feeding direction, which retard fence includes a guide for directing the bottommost media to the feed roller means, and means for mounting the pick roller means in the bottom of the bin adjacent to the retard fence.

7. The printer of claim 1 including:

a print head means adapted for printing data on the media;

a media presentation means for presenting the media to the print head means in a manner so that the print head means can print data adjacent a free leading edge of the media and adjacent a trailing edge of the media, and so that the media is appropriately spaced from the print head means.

8. The printer of claim 7 wherein said media presentation means includes:

a deflection means for deflecting the media to a position adjacent the print head means; and a preprint roller means positioned adjacent the deflection means for engaging and feeding the media in a media feeding direction against the deflection means.

9. The printer of claim 8 having an output bin, and wherein said media presentation means further includes:

an output roller means for urging the media into the output bin of the printer;

said output roller means including an output roller that with a axis of rotation that is offset from a vertical plane passing through an axis of rotation of the preprint roller means in order to accommodate the ability of the media to conform to the output roller and be urged into the output bin while maintaining the presentation of the media in substantially a vertical plane with respect to the printer head means.

10. The printer of claim 7 including means for handling the media after data has been printed on the media without smearing the data printed on the media.

11. The printer of claim 10 wherein said handling means includes a star wheel means for periodically contacting and guiding the media, which star wheel means includes a wheel mounted for rotation and which has a periphery comprised of a plurality of projections.

12. The printer of claim 1 further including:

a print head means adapted for printing data on the media;

a carriage means for transporting the print head means relative to the media so that the print head means can print data on the media;

a sensor means adapted for sensing at least the size and position of the media; and means for mounting the sensor means onto the carriage means so that the sensor means moves with the carriage means.

13. The printer of claim 1 further including:

a print head means adapted for printing data on the media:

a carriage means for transporting the print head means relative to the media so that the print head means can print data on the media;

a sensor means adapted for sensing at least a leading edge, and right and left edges of the media in order to facilitate printing adjacent to the leading edge and to determine the right to left length of the media and prevent the print head means from printing other than on the media; and means for mounting the sensor means onto the carriage means so that the sensor means moves with the print head means.

14. The printer of claim 12 further including:

a home tab means for establishing a home reference on the printer;

means for mounting the home tab relative to the carriage means so that the sensor means can sense the home tab as the carriage means transports the sensor means.

15. The printer of claim 1 including:

a sensor means adapted for sensing the presence of media to be contacted by the pick roller means;

means for mounting the sensor means adjacent to the pick roller means.

16. The printer of claim 4 including:

a sensor means adapted for sensing the width of the media from a leading edge to a trailing edge of the media; and means for mounting the sensor means adjacent to the deskew roller means.

17. The printer of claim 1 including:

print head means adapted for printing data on the media;

carriage means for transporting the print head means relative to the media; and wear surface means provided on the print head means adapted for spacing the media from the print head means.

18. The printer of claim 17 including:

secondary wear surface means provided on the carriage means adapted for spacing the media from the print head means when the wear surface means provided on the print head means has worn away.

19. The printer of claim 1 including:

print head means adapted for printing data on the media;

carriage means for transporting the print head means relative to the media; and wear surface means provided on the carriage means adapted for spacing the media from the print head means.

20. The printer of claim 4 wherein said media transporting means includes a single transport motor and means for operably coupling the single transport motor to the pick roller means, the feed roller means and the deskew roller means.

21. The printer of claim 2 including:

means for driving the retard roller in a direction reverse to the media feeding direction.

22. A printer for imprinting data on media including:

means for storing media to be imprinted;

means for transporting media to a location for imprinting;

print head means adapted for printing data on the media;

carriage means for transporting the print head means relative to the media to be imprinted;

sensor means mounted on the carriage means so as to be transportable along with the print head means for sensing the presence of the media; and wear surface means provided on the print head means adapted for spacing the media from the print head means; and secondary wear surface means provided on the carriage means adapted for spacing the media from the print head means when the wear surface means provided on the print head means has worn away.

23. The printer of claim 22 wherein:

said carriage means can transport the print head means past a leading edge of the media as well as the left and right edges of the media; and said sensor means is mounted on the carriage means such that the sensor means can sense the leading edge of the media in order to be able to allow the print head to print adjacent the leading edge of the media and such that the sensor can sense the left and right edges of the media so that the sensor can determine the left to right length of the media and thus so that the data to be imprinted on the media can be registered relative to the leading, left and right edges of the media and further thereby preventing imprinting other than on the media.

24. The printer of claim 22 wherein:

said sensor means is mounted on the carriage means such that as the carriage means is transporting the print head means relative to the media, the sensor means can sense data that has been imprinted on the media in order to determine that the print head means is functioning properly.

25. The printer of claim 22 including:

a home tab means for establishing a home reference on the printer;

means for mounting the home tab means relative to the carriage means so that the sensor means can sense the home tab means as the carriage means transports the sensor means.

26. A printer comprising:

a housing which has a base of a given size;

an input bin means adapted for holding a stack of media to be imprinted;

an output bin means adapted for holding a stack of media which has be imprinted by the printer;

means for mounting the output bin means substantially above the input bin means in order to minimize the size of the base;

a transport means adapted for transporting a bottommost media from the stack of media in the input bin means to the output bin means;

carriage means adapted for mounting and transporting a print head that can print data on the media;

wherein the transport means includes:

(a) a pick roller means having a pick roller with a rectangular cross-section adapted for urging the bottommost media out from the bottom of the stack of media;

(b) a feed roller means having a feed roller with notches provided on a periphery of the feed roller adapted for engaging the media in the notches in order to initiate the feeding of the bottommost media through the printer in a media feeding direction;

(c) a deskew roller means including a deskewing roller adapted for receiving the media from the feed roller means and deskewing the media; and (d) means (1) for driving the pick roller and the feed roller in a media feeding direction and the deskew roller in a direction opposite to the media feeding direction in order to initiate transport and deskewing of the media, and (2) for ceasing the driving of the pick roller and the feed roller and for driving the deskew roller in a media feeding direction.

27. The printer of claim 26 further including:

media presentation means adapted for receiving the media feed by the deskew roller means and for presenting the media to a print head in such a manner so that a print head can print data adjacent to a free leading edge of the media and adjacent a trailing edge of the media, and so that the media is appropriately spaced from a print head.

28. The printer of claim 27:

wherein said pick roller means, and said feed roller means are adapted for transporting the media in substantially a horizontal manner;

wherein said presentation means is adapted for transporting the media in substantially a vertical manner;

the presentation means further including:

a deflection means for deflecting the media to a position adjacent a print head;

a preprint roller means positioned adjacent the deflection means for engaging and feeding the media in a paper feeding direction against the deflection means.

29. The printer of claim 28 further including:

an output roller means for urging the media into the output bin;

said preprint roller means having a preprint roller;

said output roller means including an output roller that has an axis of rotation that is offset from a vertical plane passing through an axis of rotation of the preprint roller in order to accommodate the ability of the media to conform to the output roller and be urged into the output bin while maintaining the presentation of the media in substantially a vertical plane with respect to the printer head means.

30. The printer of claim 29 including means for handling the media after data has been printed on the media without smearing the data printed on the media.

31. The printer of claim 30 wherein said handling means includes:

a star wheel means for periodically contacting and guiding the media, which star wheel means includes a wheel mounted for rotation and which has a periphery comprised of a plurality of projections.

32. The printer of claim 26 wherein:

said input bin has a bottom which is slanted downwardly in the media feeding direction;

which input bin has a media retard fence for retarding movement of the stack of media in the media feeding direction, which retard fence includes a guide for directing the bottommost media to the feed roller means, and means for mounting the pick roller means in the bottom of the input bin adjacent to the retard fence.

33. The printer of claim 26 including:

a sensor means adapted for sensing the presence of the media; and means for mounting the sensor means to the carriage means so that the sensor means can be transported along with the print head.

34. The printer of claim 26 including:

a sensor means adapted for sensing at least the size and position of the media; and means for mounting the sensor means onto the carriage means so that the sensor means moves with the carriage means.

35. The printer of claim 26 including:

a sensor means adapted for sensing at least a leading edge, and right and left edges of the media in order to facilitate printing adjacent to the leading edge and to determine the left to right length of the media and prevent a print head from printing other than on the media.

36. The printer of claim 26 including:

a home tab means for establishing a home reference on the printer: and means for mounting the home tab means relative to the carriage means so that the sensor means can sense the home tab means as the carriage means transports the sensor means.

37. The printer of claim 26 including:

a sensor means adapted for sensing the presence of media to be contacted by the pick roller means;

means for mounting the sensor means adjacent to the pick roller means.

38. The printer of claim 26 including:

a sensor means adapted for sensing the width of the media from a leading edge to a trailing edge of the media; and means for mounting the sensor means adjacent to the deskew roller means.

39. The printer of claim 26 wherein the driving means of said transport means includes a single transport motor and means for operably coupling the single transport motor to the pick roller means, the feed roller means, and the deskew roller means.

40. The printer of claim 26 wherein said feed roller means includes:

a retard roller with means for intermeshing with the feed roller;

said feed roller including means for intermeshing with the retard roller;

said retard roller including means for allowing the retard roller to rotate in a direction reverse to the media feeding direction but not in the media feeding direction.

41. The printer of claim 40 including:

means for driving the retard roller in a direction reverse to the media feeding direction.

42. A printer comprising:

a transport means for transporting media from a stack of media;

carriage means adapted for mounting and transporting a print head that can print data on the media;

wherein the transport means includes:

(a) a pick roller means having a pick roller with a rectangular cross-section adapted for urging the bottommost media out from the bottom of the stack of media;

(b) a feed roller means having a feed roller with notches provided on a periphery of the feed roller adapted for engaging the media in the notches in order to initiate the feeding of the bottommost media through the printer in a media feeding direction;

(c) a deskew roller means including a deskewing roller adapted for receiving the media from the feed roller means and deskewing the media; and (d) means (1) for driving the pick roller and the feed roller in a media feeding direction and the deskew roller in a direction opposite to the media feeding direction in order to initiate transport and deskewing of the media, and (2) for ceasing the driving of the pick roller and the feed roller and to driving the deskew roller in a media feeding direction.

43. The printer of claim 42 wherein the driving means of said transport means includes a single transport motor and means for operably coupling the single transport motor to the pick roller means, the feed roller means, and the deskew roller means.

44. The printer of claim 42 wherein said feed roller means includes:

a retard roller with means for intermeshing with the feed roller;

said feed roller including means for intermeshing with the retard roller;

said retard roller including means for allowing the retard roller to rotate in a direction reverse to the media feeding direction but not in the media feeding direction.

45. The printer of claim 44 including:

means for driving the retard roller in a direction reverse to the media feeding direction.

* * * * *